US005881161A

United States Patent [19]

Liu

[11] Patent Number: 5,881,161

[45] Date of Patent: Mar. 9, 1999

[54] HEADPHONE

[75] Inventor: I-Chang Liu, Taichung Hsien, Taiwan

[73] Assignee: Merry Electronics Co., Ltd., Taichung, Taiwan

[21] Appl. No.: 98,381

[22] Filed: Jun. 17, 1998

[51] Int. Cl.[6] ..... H04R 25/00

[52] U.S. Cl. ..... 381/381; 381/370; 381/374

[58] Field of Search ..... 381/370, 371, 381/374, 375, 376, 377, 378, 379, 380, 381, 383; 181/128, 129, 135, 137; 379/430

[56] References Cited

U.S. PATENT DOCUMENTS

| | | | |
|---|---|---|---|
| 4,020,297 | 4/1977 | Brodie | 379/430 |
| 4,289,938 | 9/1981 | Zichy | 381/381 |
| 4,529,058 | 7/1985 | Emery | 381/374 |

*Primary Examiner*—Huyen Le
*Attorney, Agent, or Firm*—Browdy and Neimark

[57] ABSTRACT

A headphone is composed of a speaker, a microphone, and a flexible earpiece capable of being secured to the external ears of various sizes. The flexible earpiece is formed of a flexible rod which is provided at one end thereof with a female portion and at another end thereof with a male portion engageable with the female portion.

5 Claims, 3 Drawing Sheets

HEADPHONE

FIELD OF THE INVENTION

The present invention relates generally to a listening device that is connected to a communication system, and more particularly to a headphone.

BACKGROUND OF THE INVENTION

The conventional headphones are generally defective in design in that they can not be held securely to ears of various sizes.

SUMMARY OF THE INVENTION

The primary objective of the present invention is therefore to provide an improved headphone that can be held securely to ears of all sizes.

In keeping with the principle of the present invention, the foregoing objective of the present invention is attained by a headphone which is provided with a flexible rod secured to the housing of a speaker of the headphone. The flexible rod is provided at one end thereof with a female segment, and at another end thereof with a male segment. The female segment is provided with a plurality of retaining holes, whereas the male segment is provided with a plurality of retaining protrusions engageable with the retaining holes. The flexible rod can be thus secured to the external ears of various sizes.

DETAILED DESCRIPTION OF THE INVENTION

Figure 1:
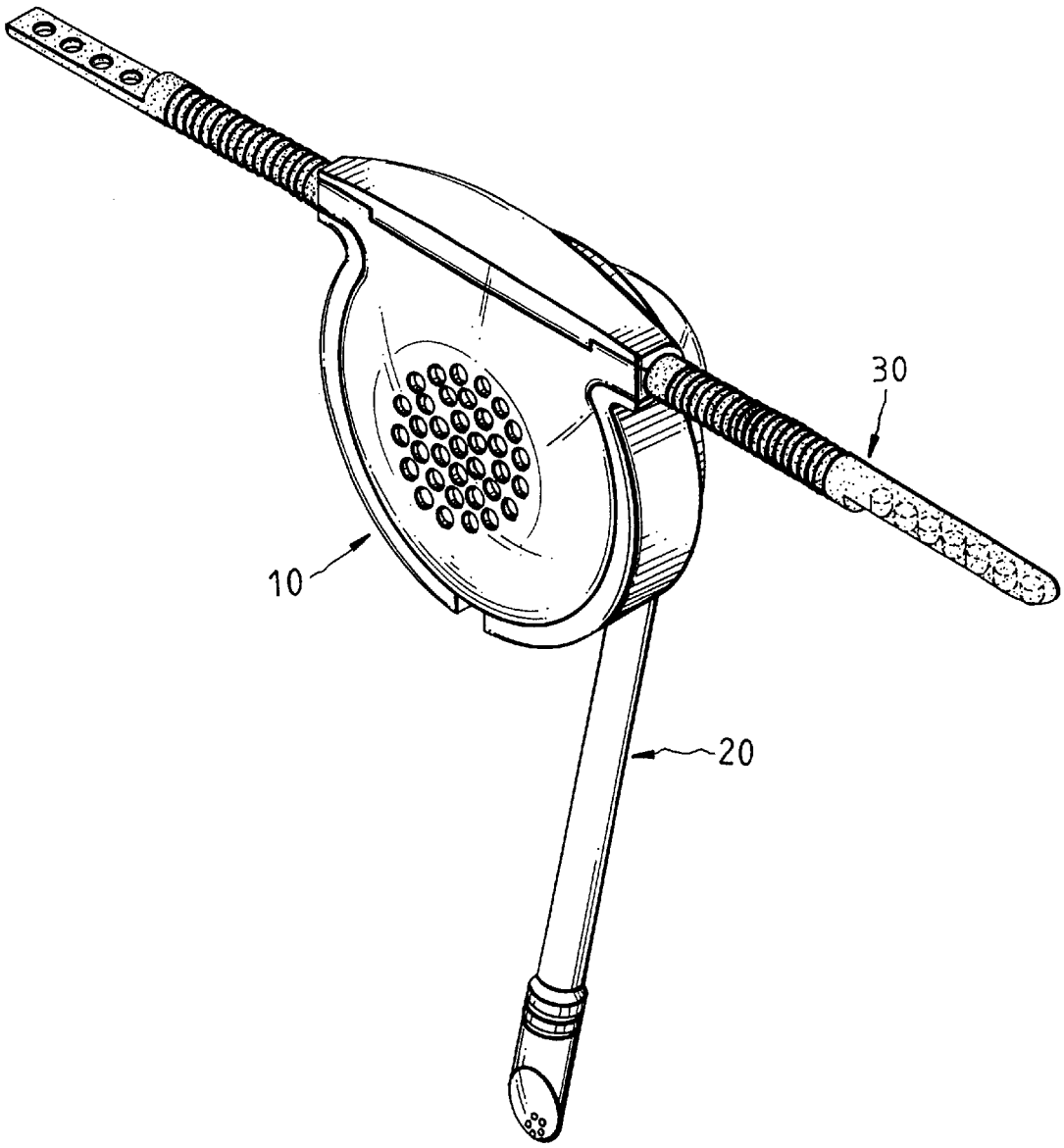
FIG. 1 shows a perspective view of a preferred embodiment of the present invention.
Figure 2:
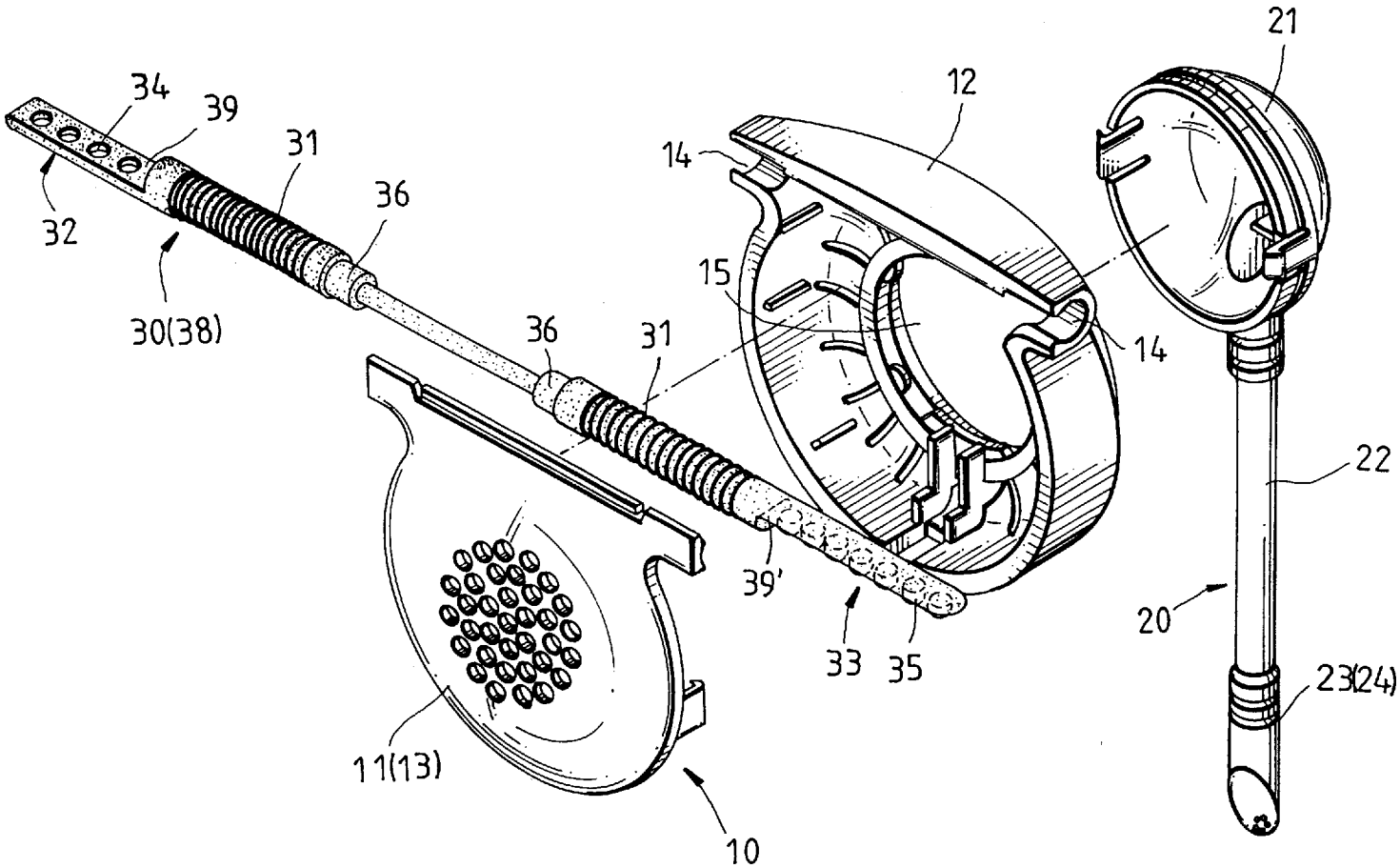
FIG. 2 shows an exploded view of the preferred embodiment of the present invention.
Figure 3:
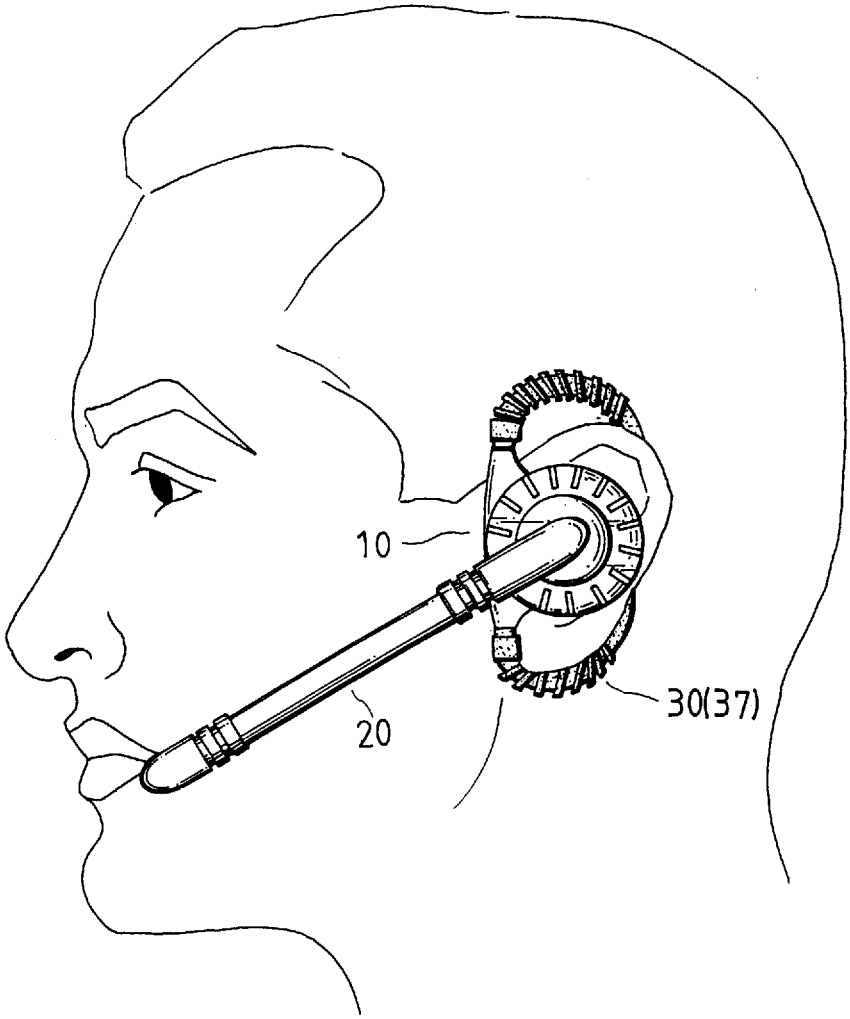
FIG. 3 shows a schematic view of the preferred embodiment of the present invention at work.

As shown in all drawings provided herewith, a headphone embodied in the present invention is composed of a speaker 10, a microphone 20, and an earpiece 30.

The speaker 10 consists of a first housing 11, a second housing 12, and a receiver 13 enclosed by the first housing 11 and the second housing 12. The second housing 12 is provided with a receiving slot 14 and a locating hole 15.

The microphone 20 consists of a base 21, a support rod 22 extending from the base 21, and a transmitter 24 located in a shell 23 of the support rod 22. The base 21 is rotatably fitted into the locating hole 15 of the second housing 12.

The earpiece 30 is formed of a flexible rod 38 which is provided at one end thereof with a female segment 32 and at another end thereof with a male segment 33. The female segment 32 is provided with a plurality of retaining holes 34, whereas the male segment 33 is provided with a plurality of retaining protrusions 35 engageable with the retaining holes 34. The earpiece 30 can be thus secured to the external ears of various sizes by bending the flexible rod 38 such that the retaining protrusions 35 are retained in the retaining holes 34 to form a connection 37.

The flexible rod 38 is further provided with two corrugated segments 31 which are located respectively in proximity of the female segment 32 and the male segment 33. The corrugated segments 31 are intended to give an added flexibility to the flexible rod 38. The flexible rod 38 is still further provided in the midsegment thereof with two stepped retaining portions 36 which are respectively adjacent to the corrugated segments 31 and are rotatably retained in the receiving slot 14 of the second housing 12 of the speaker 10.

The female segment 32 and the male segment 33 are complementary to each other such that they have a semicircular cross section. The cross section of the female segment 32 is provided with a planar surface 39, whereas the cross section of the male segment 33 is provided with a planar surface 39' capable of making contact with the planar surface of the female segment 32.

The flexible rod 38 can be secured to the ears of various sizes by bending the flexible rod 38 such that one of the retaining protrusions 35 of the male segment 33 is retained securely in an appropriate retaining hole 34 of the female segment 32. In addition, both the speaker 10 and the microphone 20 can be rotated to locate appropriately.

What is claimed is:

1. A headphone comprising:

a speaker consisting of a first housing, a second housing, and a receiver enclosed by said first housing and said second housing, said second housing provided with a receiving slot and a locating hole;

a microphone consisting of a base, a support rod extending from said base, and a transmitter located in a shell of said support rod, said microphone being rotatably fastened with said speaker such that said base of said microphone is rotatably fitted into said locating hole of said second housing of said speaker; and an earpiece formed of a flexible rod, said flexible rod provided at one end thereof with a female segment and at another end thereof with a male segment engageable with said female segment, said flexible rod further provided with two retaining portions, said flexible rod being rotatably engaged with said speaker such that said two retaining portions are rotatably retained in said receiving slot of said second housing of said speaker.

2. The microphone as defined in claim 1, wherein said female segment of said earpiece is provided with a plurality of retaining holes; and wherein said male segment of said earpiece is provided with a plurality of retaining protrusions engageable with said retaining holes of said female segment.

3. The microphone as defined in claim 1, wherein said flexible rod is provided with at least one corrugated segment for giving an added flexibility to said flexible rod.

4. The microphone as defined in claim 1, wherein said female segment has a semicircular cross section; and wherein said male segment has a semicircular cross section complementary to said semicircular cross section of said female segment.

5. The microphone as defined in claim 4, wherein said cross section of said female segment is provided with a planar surface; and wherein said cross section of said male segment is provided with a planar surface capable of making contact with said planar surface of said female segment.

* * * * *